United States Patent [19]

Le Bret et al.

[11] Patent Number: 4,697,972

[45] Date of Patent: Oct. 6, 1987

[54] METHOD FOR SEAMING END CLOSURES TO A CONTAINER BODY

[75] Inventors: Lucien F. Le Bret, Saint-Gratien; Robert Saada, Maisons-Alfort, both of France

[73] Assignee: Gallay S.A., Paris, France

[21] Appl. No.: 785,382

[22] Filed: Oct. 7, 1985

[51] Int. Cl.[4] ..... B21D 51/32

[52] U.S. Cl. ..... 413/6; 29/509; 220/67; 220/362; 220/380

[58] Field of Search ..... 29/509; 220/362, 380, 220/67; 413/6, 31, 36, 37, 38

[56] References Cited

U.S. PATENT DOCUMENTS

| | | | |
|---|---|---|---|
| 3,025,814 | 3/1962 | Currie et al. | 413/31 |
| 3,223,063 | 12/1965 | Payton | 413/7 |
| 3,263,636 | 8/1966 | Smith | 413/6 |
| 3,386,615 | 6/1968 | Jacobsen | 220/67 |
| 3,855,026 | 12/1974 | Fox et al. | 413/6 X |
| 3,912,154 | 10/1975 | Godar | 220/67 X |

FOREIGN PATENT DOCUMENTS

| | | | |
|---|---|---|---|
| 498403 | 12/1953 | Canada | 220/67 |
| 35027 | 3/1983 | Japan | 413/6 |

*Primary Examiner*—Charlie T. Moon

*Attorney, Agent, or Firm*—Russell G. Pelton

[57] ABSTRACT

A method of seaming a preformed end closure to a preformed container body of a drum or the like for forming a seam of reduced radial projection relative to the sidewall of the container body. At the start of seaming the end closure is in driving engagement with a rotating chuck and flanges of the end closure and container body are in overlying relation. The skirt of the end closure is radially spaced from the sidewall of the chuck and driving engagement therebetween is effected in the annular curved connecting zone between the skirt and recessed transverse central portion of the end closure. The skirt flares from the central portion to the flange thereof and is preferably at least in part frustoconical or has an annular step. The sidewall of the container body is centered on the skirt of the end closure and is spaced a radial distance from the chuck sidewall substantially greater than the thickness of the sheet metal of the end closure of the skirt. Driving engagement in the connecting zone may be circumferentially continuous or defined by a plurality of circumferentially spaced axially inclined ribs in the connecting zone.

17 Claims, 18 Drawing Figures

FIG. 5
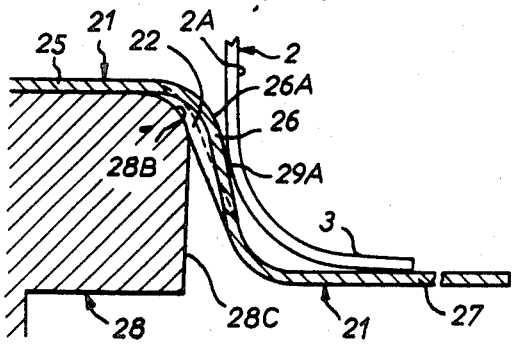
FIG. 6
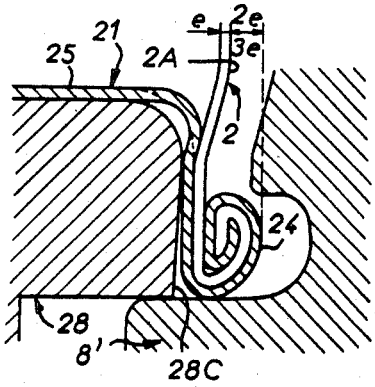
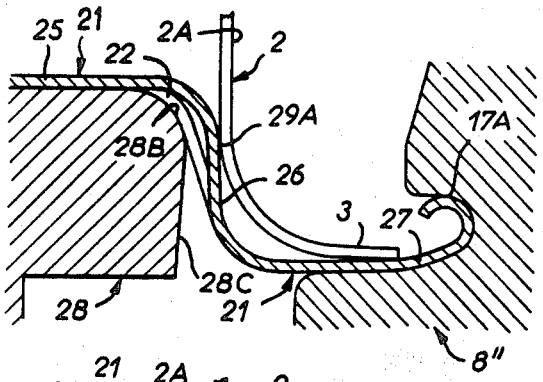
FIG. 5A
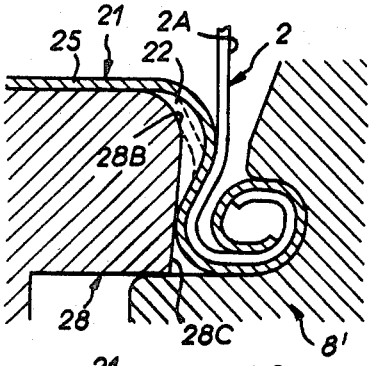
FIG. 5B
FIG. 5D
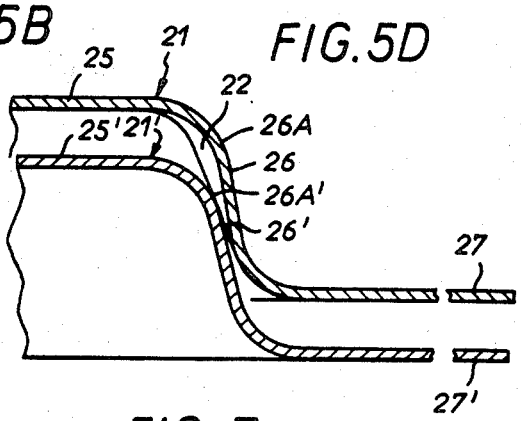
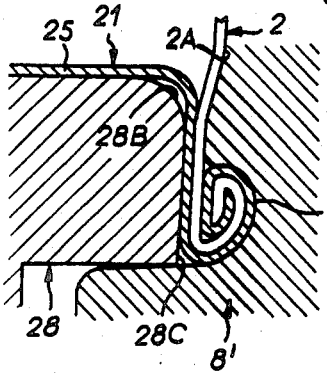
FIG 5C
FIG. 7
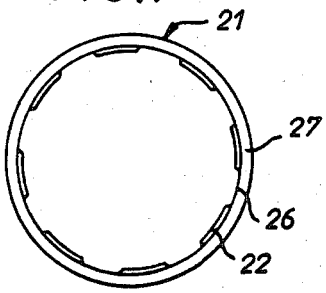

METHOD FOR SEAMING END CLOSURES TO A CONTAINER BODY

FIELD OF THE INVENTION

The present invention relates to assembling end closures to a container body and more particularly an improved seaming method.

BACKGROUND OF THE INVENTION

The present invention is directed to the manufacture of sheet material containers such as sheet metal drums, casks and the like, typically of cylindrical or polygonal cross section.

It is well known to seam end closures to the open ends of container bodies with a double or triple seam. The resulting seamed container has a chime which protrudes radially outwardly with respect to the sidewall of the container body. In the case of triple-seamed containers the outer diameter of seven layers of sheet metal defining a triple seam is thus somewhat greater than that of conventional double seamed containers.

This relatively small difference in the overall diameter may be critical and produce considerable lost space when loading 55 gallon drums in standard ISO shipping containers, namely by reducing the numbers of drums in row. In some cases the resulting total loss of capacity of the shipping container may be up to 15%.

It has been contemplated to reduce the diameter of the container body prior to the seaming operation in order to reduce the radial projection of the chime of the container. Such a method has been used successfully in the case of small-sized containers where similar problems of reducing lost space exists.

The reduction of the diameter of the ends of a container body involves a separate step prior to seaming, with attendant extra costs. Further, the end closure would have to be correspondingly reduced to adapt to the reduced diameter of the container body ends.

OBJECT AND SUMMARY OF THE INVENTION

An object of the present invention is a method for seaming end closures to a container body whereby ultimate radial projection of the chime relative to the container body sidewall is reduced in the course of seaming.

According to the invention there is provided a method of assembling one or both end closures to a container body by seaming flanges of the end closure and container body together. A preformed end closure is provided having a recessed transverse central portion, an axially extending skirt and a flange radially outwardly extending from the skirt and a container body with a flange radially outwardly extending flange from its sidewall. The end closure is positioned on a rotating chuck in driving engagement therewith, the end closure skirt radially spaced from the chuck sidewall. The container body is nested relative to the end closure with the flanges in mutual engagement. A suitably shaped seaming tool is radially displaced inwardly to roll the flanges into a seam while deforming the skirt of the end closures against the chuck sidewall thereby reducing the effective radial projection of the resulting seam relative to the container body sidewall.

The initial clearance between the skirt of the end closure and the chuck sidewall enables the diameter of the end of the container body to be reduced and thereby the relative radial projection of the chime in the course of seaming. Accordingly, the cost of seaming is substantially that of a corresponding conventional double or triple seaming operation. In fact there may be attendant cost savings, thanks to the reduced radial extent of the flanges of the end closure and the container body, since the length of sheet material therefor is less than in the prior art because the resulting seam is located closer to the axis of the container.

Preferably, the end closure skirt flares from the recessed transverse central portion to the flange and the driving engagement is defined by complementary connecting zones of the chuck and the preformed end closure. Although the flaring skirt is preferably frustoconical (the half angle of which is largely responsible for the reduction of radial projection of the ultimate seam) it may be only partly frustoconical or comprise an annular step axially midway thereof.

According to an alternative embodiment there are circumferentially spaced, radially protruding and axially inclined ribs in the connecting zone of the end flange.

According to another aspect of the invention there is provided a stackable preformed end closure adapted to be seamed to a container body comprising a recessed transverse central portion, a skirt extending axially and radially from the central portion and annular concave connecting zone joining the central portion to the skirt, and a flange extending radially outwardly from the skirt axially remote from the central portion. A plurality of inwardly protruding hollow bosses means are formed in the concave connecting zone and are adapted to engage a corresponding connecting zone of a seaming chuck for driving the end closure in rotation with the chuck. The boss means are also engageable with the connecting zone of an identical subjacent end closure stacked in nesting relation therewith so that the flange of the first mentioned end closure and the subjacent end closure are axially spaced from each other to facilitate separation and handling. Preferably the hollow boss means comprise axially inclined ribs extending from the central portion to about midway along the skirt between the central portion and the flange.

In all cases the container body is in centered engagement on the skirt of the end closure. The location of this contact zone varies according to the desired embodiment. Generally this does not require modification of the configuration of the container body except for the radius of the connecting zone between the sidewall and the flange thereof. Alternatively, however an annular indentation or the like may be formed in the container body sidewall to insure the centering contact zone with the end closure.

It will be appreciated that the diameter of the usual rolling hoops axially spaced along the container body will be adapted to that of the chimes. Thus, in case of triple-seamed drums assembled according to the invention, the diameter of the rolling hoops will be made correspondingly smaller compared with those of current triple-seamed drums.

The present invention is particularly suited for triple seams in which case it is possible to reduce the radial projection of the chime beyond the nominal container body sidewall. The invention is also applicable to double seams where the diameter of the chime can be reduced to that of the nominal diameter of the container body sidewall.

These other features and advantages will be brought out in the description which follows, given by way of example, with reference to the accompanying drawings.

BRIEF DESCRIPTION OF THE DRAWINGS

FIG. 5 is a partial cross-sectional view, similar to FIG. 3 for a second embodiment of the invention;

FIG. 5A shows the relative position of the flanges of the container body and the end closure after a first stage of the seaming operation for the embodiment of FIG. 5;

FIG. 5B shows the relative position of the flanges of the container body and the end closure in a second stage of the seaming operation when the connecting zone between the end flange and the skirt of the end closure comes into contact with the chuck sidewall;

FIG. 5C shows the completed triple seam for the embodiment of FIG. 5 at the end of seaming tool displacement;

FIG. 5D shows in partial cross-section two preformed end closures of the embodiment of FIG. 5 in stacked relation.

FIG. 6 shows the triple seam of FIG. 5C when the seaming tool is partially withdrawn from its position in FIG. 5C;

FIG. 7 is a bottom view of the end closure of FIG. 5;

DESCRIPTION OF THE PREFERRED EMBODIMENTS

Figure 1:
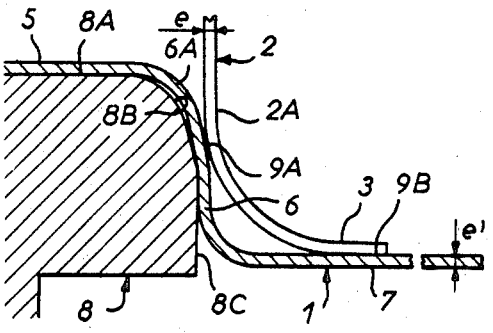
PRIOR ART FIG.1
FIG. 1 is a partial cross-sectional view of a flanged container body and flanged end closure received on a chuck prior to seaming, according to the prior art.
Figure 2:
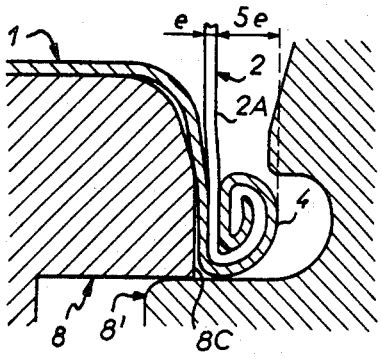
FIG. 2 is a partial cross-sectional view of a completed triple seam, as the seaming tool is withdrawn from the chuck, according to the prior art.

FIGS. 1 and 2 illustrate the triple seaming of a sheet metal end closure to a sheet metal container body 2 of a drum according to the method disclosed in U.S. Pat. No. Re. 29,307, reissued to the assignee of the present application and incorporated herein by reference.

The end closure 1 and the container body 2 are suitably preformed. The sidewall of a container body 2 has a radially outwardly extending flange 3 joined thereto by a large radius annular connecting zone. The preformed end closure 1 comprises a recessed transverse central portion 5 joined by an annular concave connecting zone 6A to a generally cylindrical skirt 6 which is flanged to form a radially outwardly extending flange 7 of a predetermined length for triple seaming. The thickness of the container body 2 is e and that of the end closure 1 is e′ which for the purposes of the further description will be considered equivalent.

The preformed end closure 1 is force fitted onto a rotatable chuck 8 which comprises an endwall 8A joined by a radiused connecting portion 8B to a cylindrical sidewall 8C. The transverse central portion 5 of the end closure 1 bears against the chuch endwall 8A and the skirt 6 of the end closure 2 is tightly gripped against the cylindrical sidewall 8C of the chuck 8. For this purpose the sidewall 8C of the chuck 8 may be knurled to improve the driving engagement between it and the adjacent skirt 6. The annular connection zone 6A is normally out of contact with the annular connecting portion 8B. The end closure 1 thus sits on the chuck like a brimmed hat putted down on one's head.

Thereafter the container body 2 is received on the end closure 1 with the flanges 3 and 7 overlying each other, the connecting zone joining the flange 3 to the container body 2 comes into centering engagement with the skirt 6 of the enclosure at 9A proximate to the junction of the sidewall 8C with the curved connecting portion 8B. The free end edge 9B of the container body flange 3 bears against the end closure flange 7 along a circle spaced inwardly from the free edge of the end closure flange 7.

The seaming operation is carried out by the displacing the seaming tool or roll 8′ radially inwardly against the flanges 7 and 3 of the end closure 1 and the container body 2 while rotating the chuck 8. Owing to the configuration of the seaming tool(s) 8′ a suitably shaped triple seam is obtained as illustrated in FIG. 2, with the flanges 7 and 3 rolled together against the outer side 2A of the end of the container body 2 and the skirt 6 of the end closure 1 to define seven thicknesses of sheet metal. Upon the withdrawal of the seaming tool the chime 4 spring slightly outwardly away from the chuck sidewall leaving an annular wedge-shaped space therebetween (see FIG. 2) thus increasing the effective diameter of the resulting chime 4. The radial projection of the resulting chime 4 from the container body sidewall is about 5 times the thickness e of the sheet metal, i.e. 5*e*, as shown.

In the various embodiments of FIGS. 3–14 the outer diameter of the resulting seam is reduced in the course of seaming.

Figure 3:
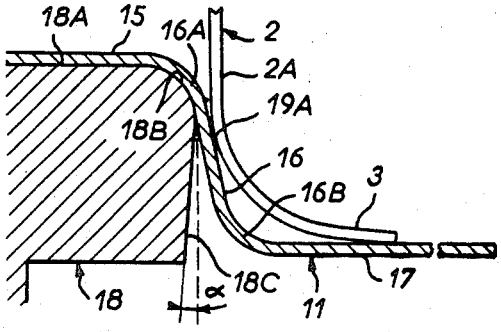
FIG. 3 is a partial cross-sectional view corresponding to FIG. 1 showing the flanged container body and end closure on the chuck prior to the commencement of seaming, according to a first embodiment of the invention.

In the first embodiment of the invention shown in FIG. 3, there is provided a preformed container body 2 identical to that illustrated in FIG. 1 and described above. The end closure 11 as preformed, for example in a press, is of different configuration that that of the prior art. The end closure 11 comprises a recessed central transverse wall 15 joined by an annular concave curved connecting zone 16A to a frustoconical skirt 16 flaring axially outwardly, or downwardly as illustrated, which is joined by an annular concave zone 16B to a radially extending flange 17.

The end closure 11 is received in place on the chuck 18 substantially as in the prior art. The chuck sidewall 18C is tapered axially outwardly, or downwardly as illustrated, at an angle $\alpha$ relative to the vertical of the chuck axis (not shown). The sidewall 16, by contrast to the illustrated prior art which insured the driving contact between the end closure and the chuck, is radially spaced from the chuck sidewall 18C. In the embodiment the driving engagement for rotating the end closure 11 with the chuck 18 is effected by tight mating contact between the complementarily shaped connecting zone 16A of the end closure and the connecting portion 18D of the chuck. Since the frictional engagement is effected through the connecting portion 18B of the end closure 11 it is possible to reduce the radius of the chuck sidewall 18C without reducing the radial dimension of the end of the container body sidewall.

Figure 4:
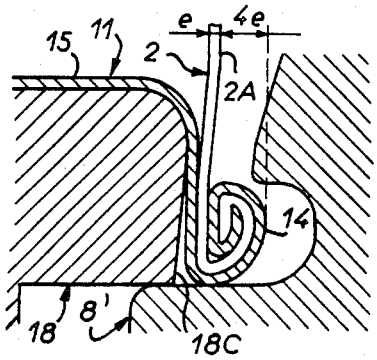
FIG. 4 is a partial cross-sectional view showing a completed triple seam of reduced radial projection for the embodiment of FIG. 3, as the seaming tool is withdrawn from the chuck.

FIG. 4 illustrates the completed triple seam or chime 14 comprising seven layers or thicknesses of end closure and container body sheet material after the seaming tool 8' has been withdrawn partially for its return movement to the starting position (not shown). It will be understood, as described in greater detail in connection with FIGS. 5A, 5B and 5C that in the course of seaming the frustoconical skirt 16 is deformed into substantially cylindrical configuration, as illustrated, by the radially inward driving action of the seaming tool 8'. At the end of the radially inward movement of the seaming tool 8' the inner surface of the skirt 16 bears flush against the tapered chuck sidewall 18C. Upon withdrawal of the seaming tool 8' the resilience of the sheet metal causes the finished triple seam 14 to spring slightly radially outwardly and out of contact with the tapered sidewall 18C, as illustrated in FIG. 4.

As noted above in connection with the prior art, the spring back of the chime necessarily increases the resulting radial projection of the chime. With the tapered sidewall 18C of the chuck according to the invention, it is possible to further reduce the radial projection of the chime. The resulting skirt 16 of the end closure returning to a generally cylindrical configuration after spring back. The angle $\alpha$ of taper of the chuck sidewall 18C is selected to permit relatively easy withdrawal of the chuck after seaming is completed. To this end the taper angle $\alpha$ preferably ranges up to 5°, and is more preferably about 3°. The chuck 18 also may be equipped with an extractor device generally in use in the art to facilitate the removal of the chuck from inside the recessed end closure of the container.

Owing to the combination of the tapered chuck sidewall 18C and the increased radial clearance between the inner surface of the container body 2 and the chuck sidewall 18C, resulting radial projection of the completed triple seam chime 14 relative to the outer surface 2A of the container body is about four times the thickness e, e' of the sheet metal of the end closure 11 and container body, that is about the thickness e, e' of the sheet metal less than that of the prior art triple seam chime of FIG. 2.

FIGS. 5, 5A, 5B, 5C, 5D, 6 and 7 illustrate a second embodiment of the invention. Again the starting preformed container body 2 is the same as the prior art of FIGS. 1 and 2. The end closure 21 is of different configuration and comprises in the connecting zone between the frustoconical skirt 26 flaring downwardly as illustrated and the recessed transverse central recessed portion 25 a plurality of equally or unequally circumferentially spaced, radially inwardly offset and axially inclined ribs 22 (see FIGS. 5 and 7). The radially inwardly facing surface of the ribs 22 is curved in the plane of FIG. 5 so as to mate with the curvature of the convex curved connecting portion 28B of the chuck 28.

Due to the radial depth of the ribs 22 in the arrangement of the embodiment of FIG. 5, the rest of the frustoconical skirt 26 of the end closure 21 is spaced farther from the chuck sidewall 28C which as in the FIG. 4 embodiment is tapered downwardly as illustrated. The annular zone of contact 29A between the frustoconical skirt 26 and the adjacent portion of the container body 2 is likewise radially farther from the chuck sidewall 28C.

The contact zones between chuck 28 and the end closure 21 is circumferentially interrupted and alternates with the unribbed curved connecting zones between the container body 2 and the end closure 21. This arrangement is satisfactory for gripping engagement necessary for slipless rotation of the end closure 21 on the chuck and centering of the container body 2 with the end closure 21.

As illustrated in FIG. 5D and according to another aspect of the invention, such preformed end closures 21 are easily stackable. Because of the arrangement of the FIG. 5 embodiment the circumferentially alternating ribs 22 are adapted to engage the convex side of the curved connecting zone 26A' of the subjacent end closure 21'. Thus the central portions 25 and 25' are axially spaced from each other as are the flanges 27 and 27'. It will be immediately appreciated that this arrangement will facilitate the handling of preformed end closures and avoid problems which have traditionally been posed in the art. Obviously, for the foregoing reason, it is preferable to select the circumferential dimension of the ribs to be greater therewith. Thus, irrespective of the angular orientation there will be a high probability of engagement between the inclined ribs 22 and the subjacent unribbed curved connecting zones 26A'.

The seaming procedure will now be described in greater detail in connection with FIGS. 5A, 5B and 5C.

FIG. 5A shows the first step in forming a triple seam in which a first seaming tool 8'' is displaced radially inwardly to form an annular hook 17A and the entire radially outer portion of the flange 27 is driven above the free end of the container body flange 3.

After the first step, another seaming tool 8' rolls both flanges 3 and 27 together with respect to each other and at the same time drives the end closure skirt 26 and the large radiused connecting zone of the container body radially inwardly against the chuck sidewall 28C as illustrated in FIG. 5B.

In the course of further radial displacement of the seaming tool 8' the rolling of the flanges 3 and 27 is continued to form a tight rolled seam with the free edge portions clinching each other as illustrated in FIG. 5C. At the same time the skirt 26 of the end closure 21 is "flattened" against the chuck sidewall 28C.

Upon withdrawal of the seaming tool 8' (see FIG. 6) the entire chime 24 tends to spring back slightly radially outwardly owing to the inherent resilience of the skirt 26 and the adjacent end portion of the container body 2 so as to form a slight annular wedge-shaped clearance between the radially inner wall of the chime and the facing portion of the chuck sidewall 28C.

Thanks to the presence of the radial ribs 22 it is possible to further decrease the radial projection of the resulting chime to about three times the thickness e of the sheet metal, as illustrated in FIG. 6. The actual ribs 22 are flattened in the skirt zone against the chuck sidewall 28C and are present at the completion of seaming in the curved connecting zone only.

Figure 8:
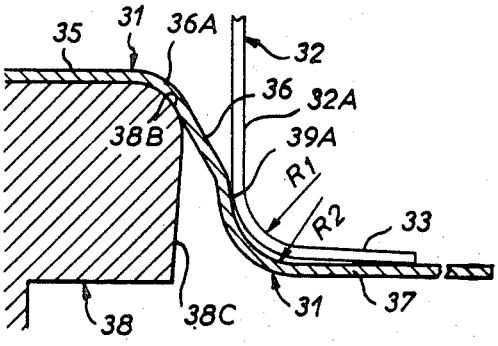
FIG. 8 is a partial cross-sectional view similar to that of FIG. 3 for another embodiment of the invention.

A further embodiment will now be described in connection with FIGS. 8 and 9. FIG. 8 illustrates a preformed end closure 31 and a preformed container body 32 received on a chuck 38. In this embodiment the radius of curvature R1 of the connecting zone between the sidewall container body 32 and container body flange 33 is smaller than in the previous embodiments. The end closure 31 comprises a recessed transverse central portion 35 joined by an annular curved connecting zone 36A to a radially outwardly, or downwardly, flaring frustoconical skirt 36 of greater half angle than that of skirts 16 and 26, which is joined about axially midway between the central portion 35 and flange 37 by a curved connecting zone having a radius R2. The connecting zone of the container body 32 having a radius R1 nests in the connecting zone having a radius R2 of the end closure 31 owing to an appropriate selection of the radii. In practice the radius R2 is slightly greater than radius R1. The container body 32 is in contact with the end closure 31 at the free edge of the end container flange 33 and centering contact at 39A proximate to the inflection zone between the frustoconical skirt 36 and the convex connecting zone of radius R2.

Figure 9:
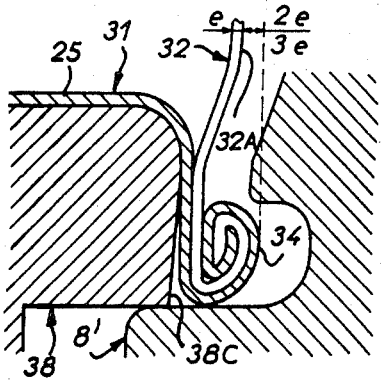
FIG. 9 is a partial cross-sectional view of a completed triple seam for the embodiment of FIG. 8.

Seaming is effected as described above and the resulting triple seam is illustrated in FIG. 9. The radial projection of the resulting triple seam 34 beyond the nominal radius of the sidewall 32A in this embodiment is about two to three times the thickness e of the sheet metal. In this respect it is pointed out that the particular configuration of the skirt of the preformed end closure 31 (FIG. 8) permits the container body sidewall to be spaced a distance from the chuck sidewall 38C substantially the same as in the preceding embodiment, and results in a seam whose radial projection is equivalent to that of FIG. 6.

Figure 10:
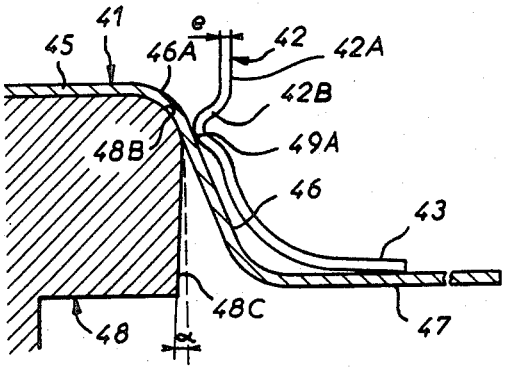
FIG. 10 is a partial cross-sectional view similar to that of FIG. 3 for yet another embodiment of the invention.
Figure 11:
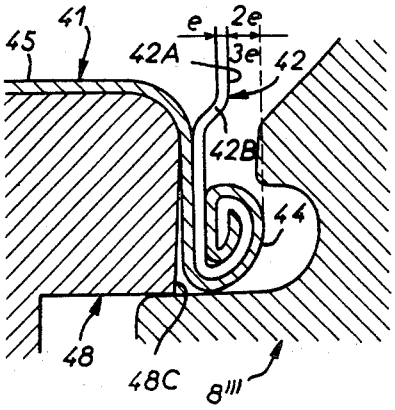
FIG. 11 is a partial cross-sectional view with the seaming tool partially withdrawn after completion of the triple seam for the embodiment of FIG. 10.

In FIGS. 10 and 11 the end closure 41 and the container body 42 are both of different configuration from the preceding embodiments.

First, the overall shape of the end closure 41 is substantially the same as that of FIG. 3 and includes a recessed transverse central portion 43 joined to a flared frustoconical skirt 46 by a concave curved zone 46B, the frustoconical skirt 46 is in turn joined to a radially outwardly extending flange 47 by a convex connecting zone. The FIG. 10 end closure 41 differs from that of FIG. 3 by the greater angle flare of the skirt 46 compared to the skirt 16.

The container body 42 comprises a cylindrical sidewall and radial flange 43 at the end of an annular connecting zone, as in the previous embodiments. A radially outwardly opening indentation 42B of C-shaped cross section engages the end closure 41 at the inflection zone 49A between the concave connecting zone 46A and the frustoconical skirt 46. It will be noted that the even though the container body sidewall 42 is substantially radially spaced from the chuck sidewall 48C, the driving engagement zone 49A is virtually at minimal spacing from the chuck sidewall and bears directly through the end closure against the chuck 48.

The resulting triple seam 44 is illustrated in FIG. 11. The radial projection of the triple seam 44 with respect to the nominal container body sidewall 42A is about two to three times the thickness e of the sheet metal.

At the location of the axially inner, or upper, flank of the indentation 42A there remains an oblique annular section which is shaped by the oblique upper face of the seaming tool 8''' at the end of the inward seaming tool displacement.

Figure 12:
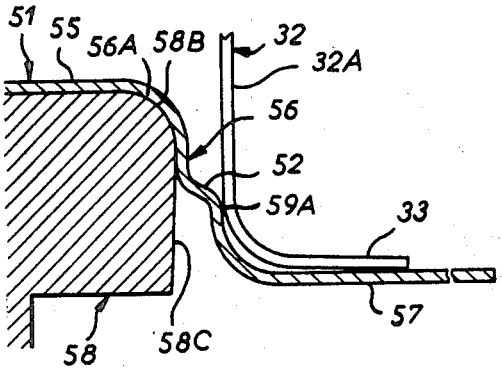
FIG. 12 is a partial cross-sectional view similar to that of FIG. 3 for still another embodiment.
Figure 13:
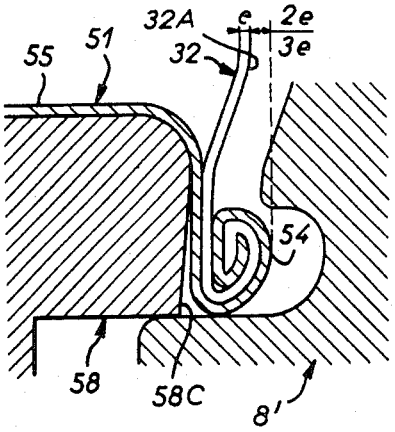
FIG. 13 shows the completed triple seam for the embodiment of FIG. 12, with the seaming tool partly withdrawn.

FIGS. 12 and 13 illustrate a final embodiment for forming a triple seam of reduced radial projection according to the invention. The container body sidewall and flange 33 are substantially as illustrated in FIGS. 8 and 9, with a relatively small radius connecting zone. The preformed end closure 51 comprises a recessed transverse central portion 55 which is surrounded by an annular concave connecting zone 56A in intimate mating relationship with the curved connecting zone 58B between the chuck endwall and chuck sidewall 58C. Axially midway between the radial flange 57 of the end closure 51 and the central portion 55 is an annular step 52 which increases in diameter from the concave connecting zone 52 to the convex connecting zone of the end closure 51. The engagement zone 59A between the end closure 56 and the container body 32 is at the radially outermost portion of the step 52. The annular step 52 is slightly frustoconical and slopes radially and axially outwardly, or downwardly, as illustrated.

The resulting triple seam 54 is similar to that of illustrated in FIG. 9. As in that case the radial projection of the chime beyond the nominal container body sidewall between about two to three times the thickness e of the sheet metal.

Figure 14:
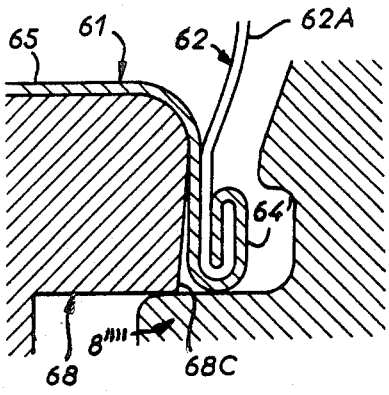
FIG. 14 shows a completed double seam of reduced radial projection with the seaming tool partly withdrawn, produced according to the method of the invention.

FIG. 14 shows the principle of the present invention applied to assembling an end closure 61 to the end of a container body 62 with a conventional double seam 64. The double seaming tool 8'''' is conventional. The chuck 68 has an axially outwardly, or downwardly, tapered sidewall 68C which prior to seaming is radially spaced from the container body sidewall a distance greater than the thickness of the end closure 61 as illustrated in any of the previous embodiments. Obviously the lengths of the flanges of the preformed container body and end closure have to be sized for a double seam. The radial projection of the double seam 64 relative to the nominal container body sidewall 62A is virtually nil and for this reason provides optimum packing capacity for drums in a given space. The double seam 64 may be suitable for certain uses through those skilled in the art may prefer a triple seamed drum for its enhanced chime strength.

While several preferred embodiments have been described and illustrated herein, it will be appreciated that variations and alternatives may be employed to form seams having reduced radial projections relative to the nominal container body sidewall. In all cases the effective diameter of the chime is reduced in the course of seaming, sufficient radial clearance being provided between the sidewall of the chuck and the container body sidewall to enable such reduction of the end diameter of the drum or the like.

It will be appreciated by those skilled in the art that the handling of the drum or other container assembled according to the invention by means of suitable grips cooperating with the seam will be unchanged from prior art practice.

In this respect the frustoconical zone formed in the container body sidewall spaced axially inwardly of the seam may be beneficial.

Although the sidewall of the container body described herein is generally cylindrical, the present invention is readily applicable to container bodies of different cross section, e.g. polygonal, amongst others.

The preformed end closures and container bodies disclosed herein are preferably formed as illustrated by stamping operations well known in the art.

What we claim is:

1. A method of assembling an end closure to a container body by seaming flanges of the end closure and container body together, comprising the steps of:

providing a preformed end closure having a recessed transverse central portion, a skirt axially and radially extending away from the central portion, and a flange radially outwardly extending from the skirt, and a preformed container body having a sidewall and flange radially outwardly extending from the container body sidewall;

providing a rotatable chuck having an end and circumferential sidewall, and radially displaceable seaming tool;

positioning the end closure on the chuck end in driving engagement therewith, the end closure skirt being circumferentially radially spaced from the chuck sidewall;

nesting the container body relative to the end closure into centered engagement therewith with their flanges in mutual engagement; and displacing the seaming tool radially inwardly while rotating said chuck to roll the flanges into a seam while deforming the skirt of the end closure against the chuck sidewall thereby reducing the radial projection of the resulting seam relative to the container body sidewall.

2. A method according to claim 1, wherein the central portion is joined to the skirt of the end closure by an annular concave connecting zone and the chuck has a connection portion between its sidewall and its endwall complementary to that of the annular concave connecting zone of the end closure, the driving engagement being defined by contact between the end closure connecting zone and the connecting portion of the chuck.

3. A method according to claim 1, wherein the radius of the container body sidewall at the seam is less than the radius of the nominal container body sidewall axially inwardly of the end closure.

4. A method according to claim 1, wherein during seaming tool displacement the radius of the container body sidewall at the seam is reduced relative to the rest of the container body sidewall.

5. A method according to claim 3, further comprising forming, during seaming tool displacement, a tapered zone in the container body sidewall substantially at the level of the central portion of the end closure.

6. A method according to claim 3, wherein the skirt of the preformed end closure flares axially outwardly between the recessed central portion and the flange.

7. A method according to claim 3, wherein the skirt of the preformed end closure has an annular step substantially axially midway between the central portion and the flange thereof.

8. A method according to claim 3, wherein the skirt of the preformed end closure is frustoconical and joined to the central portion by a concave connecting zone and the flange by a convex connecting zone.

9. A method according to claim 3, wherein a portion of the skirt of the preformed end closure is frustoconical and is joined to the central portion of the end closure by a concave connecting zone and the flange by a convex connecting zone, the inflection between the frustoconical portion and the convex connecting zone defining a zone of contact for centering the container body relative to the end closure.

10. A method according to claim 3, further comprising forming a plurality of circumferentially spaced, radially inwardly offset and axially inclined ribs in the end closure between the skirt and the central portion for providing driving engagement between the chuck and the preformed end closure along the radially inward facing surface of the ribs.

11. A method according to claim 8, wherein the preformed end closure includes a plurality of circumferentially spaced zones formed between the central portion and the skirt for driving engagement with the chuck.

12. A method according to claim 1, wherein the centering of the container body relative to the end closure is effected by an annular indentation in the container body sidewall proximate to the axially inner end of the skirt.

13. A method according to claim 12, wherein a portion of the indentation defines at the completion of seaming an annular step in the container body sidewall, between the end of the container body sidewall where the seam is formed and the rest of the container body sidewall.

14. A method according to claim 8, wherein the convex connecting zone comes into engagement with the chuck sidewall before the skirt is deformed against the chuck sidewall at the end of radial inward seaming tool displacement.

15. A method according to claim 1, wherein the chuck has a transverse end wall and the chuck sidewall tapers axially outwardly from the end wall thereof.

16. A method according to claim 15, wherein the angle of taper of the chuck sidewall relative to the axis of the chuck is in a range up to 5°.

17. A method according to claim 15, wherein the angle of taper of the chuck sidewall relative to the axis of the chuck is about 3°.

* * * * *

REEXAMINATION CERTIFICATE (1484th)

United States Patent [19] [11] B1 4,697,972

Le Bret et al. [45] Certificate Issued Jun. 4, 1991

[54] METHOD FOR SEAMING END CLOSURES TO A CONTAINER BODY

[75] Inventors: Lucien F. Le Bret, Saint-Gratien; Robert Saada, Maisons-Alfort, both of France

[73] Assignee: Gallay S.A., Paris, France

Reexamination Request:
No. 90/002,098, Jul. 30, 1990

Reexamination Certificate for:

| | |
|---|---|
| Patent No.: | **4,697,972** |
| Issued: | **Oct. 6, 1987** |
| Appl. No.: | **785,382** |
| Filed: | **Oct. 7, 1985** |

[51] Int. Cl.[5] ..... B21D 51/32
[52] U.S. Cl. ..... 413/6; 29/509; 220/67; 220/362; 220/380
[58] Field of Search ..... 413/4–7, 413/31, 36, 37; 20/362, 380; 29/509

[56] References Cited

U.S. PATENT DOCUMENTS

| | | | |
|---|---|---|---|
| 423,295 | 3/1890 | Walsh | 413/6 |
| 3,025,814 | 3/1962 | Currie et al. . | |
| 3,223,063 | 12/1965 | Payton . | |
| 3,263,636 | 8/1966 | Smith . | |
| 3,386,615 | 6/1968 | Jacobsen . | |
| 3,855,026 | 12/1974 | Fox et al. | 156/67 |
| 3,912,154 | 10/1975 | Godar | 229/5.5 |
| 4,512,700 | 4/1985 | Santoni | 413/4 |

FOREIGN PATENT DOCUMENTS

| | | |
|---|---|---|
| 498403 | 12/1953 | Canada . |
| 5835027 | 3/1983 | Japan . |

OTHER PUBLICATIONS

Project Study, Van Leer, Sep. 1983, German version and French translation.

German Patent No. DT 20 38 540 B2; Mar. 1976; Coppens.

German Patent No. DT 26 32 270 A1; Feb. 1977; Wessely.

U.S. Patent No. 4,055,133 Corresponding to German Patent DT 26 32 270 A1.

U.S. Patent No. 3,263,636, C. J. Smith, Issued Aug. 2, 1966; cited in Reexamination and not Enclosed Herewith French Patent No. 1.324.373; Gallay S.A.; 1963.

M. G. R. Company Catalogue of Feb. 1983, p. 12; Machine MCA/200; Machine AA/2.

German Standards Sheet DIN 2008, p. 2, Oct. 1972.

German Standards Sheet DIN 2040, Dec. 1958.

European Patent No. 0 162 873; 9/87; Serr.

French Patent No. 1.533.260; Carnaud; 1968.

British Patent No. 1 220 129 Corresponding to French Patent No. 1.533.260.

Translation of French Patent No. 1.533.260.

*Primary Examiner*—Frederick R. Schmidt

[57] ABSTRACT

A method of seaming a preformed end closure to a preformed container body of a drum or the like for forming a seam of reduced radial projection relative to the sidewall of the container body. At the start of seaming the end closure is in driving engagement with a rotating chuck and flanges of the end closure and container body are in overlying relation. The skirt of the end closure is radially spaced from the sidewall of the chuck and driving engagement therebetween is effected in the annular curved connecting zone between the skirt and recessed transverse central portion of the end closure. The skirt flares from the central portion to the flange thereof and is preferably at least in part frustoconical or has an annular step. The sidewall of the container body is centered on the skirt of the end closure and is spaced a radial distance from the chuck sidewall substantially greater than the thickness of the sheet metal of the end closure of the skirt. Driving engagement in the connecting zone may be circumferentially continuous or defined by a plurality of circumferentially spaced axially inclined ribs in the connecting zone.

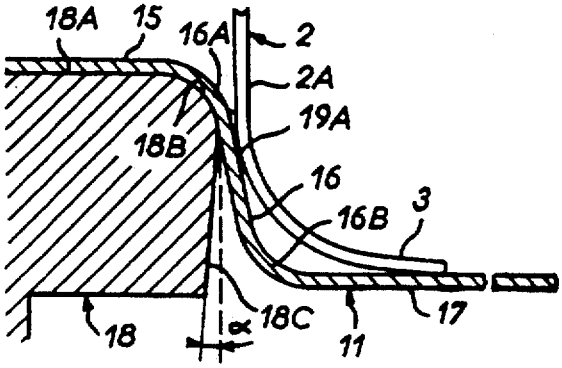

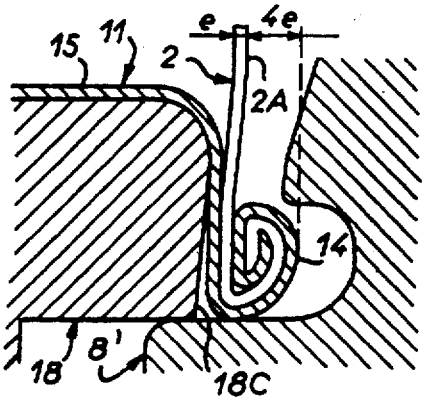

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, lines 55-67:

FIGS. 5, 5A, 5B, 5C, 5D, 6 and 7 illustrate a second embodiment of the invention. Again the starting preformed container body 2 is the same as the prior art of FIGS. 1 and 2. The end closure 21 is of different configuration and comprises in the connecting zone between the frustoconical skirt 26 flaring downwardly as illustrated and the recessed transverse central recessed portion 25 a plurality of equally or unequally circumferentially spaced, radially inwardly *extending or* offset and axially inclined ribs 22 (see FIGS. 5 and 7). The radially inwardly facing surface of the ribs 22 is curved in the plane of FIG. 5 so as to mate with the curvature of the convex curved connecting portion 28B of the chuck 28.

Column 7, lines 1-23:

A further embodiment will now be described in connection with FIGS. 8 and 9. FIG. 8 illustrates a preformed end closure 31 and a preformed container body 32 received on a chuck 38. In this embodiment the radius of curvature R1 of the connecting zone between the sidewall container body 32 and container body flange 33 is smaller than in the previous embodiments. The end closure 31 comprises a recessed transverse central portion 35 joined by an annular curved connecting zone 36A to a radially outwardly, or downwardly, flaring frustoconical skirt 36 of greater half angle than that of skirts 16 and 26, which is joined about axially midway between the central portion 35 and flange 37 by a curved connecting zone having a radius R2. The connecting zone of the container body 32 having a radius R1 nests in the connecting zone having a radius R2 of the end closure 31 owing to an appropriate selection of the radii. In practice the radius R2 is slightly greater than radius R1. The container body 32 is in contact with the end closure 31 at the free edge of the end container flange 33 and centering contact at 39A proximate to the *concave* inflection zone between the frustoconical skirt 36 and the convex connecting zone of radius R2.

AS A RESULT OF REEXAMINATION, IT HAS BEEN DETERMINED THAT:

Claims 1, 2, 3, 10 and 15 are determined to be patentable as amended.

Claims 4-9, 11-14 and 16-17, dependent on an amended claim, are determined to be patentable.

New claims 18-32 are added and determined to be patentable.

1. A method of assembling an end closure to a container body by seaming flanges of the end closure and container body together, comprising the steps of:

providing a preformed end closure having a recessed transverse central portion, a skirt axially and radially extending away from the central portion, and a flange radially outwardly extending from the skirt, and a preformed container body having a sidewall and flange radially outwardly extending from the container body sidewall;

providing a rotatable chuck haivng an end and circumferential sidewall, and radially displaceable seaming tool;

positioning the end closure on the chuck end in driving engagement therewith, the end closure skirt being circumferentially radially spaced from the chuck sidewall;

nesting the container body relative to the end closure into centered engagement therewith with their flanges in mutual engagement; and displacing the seaming tool radially inwardly while rotating said chuck to roll the flanges into a seam *having a radial projection* while deforming the skirt of the end closure against the chuck sidewall thereby reducing the radial projection of the [resulting] seam relative to the container body sidewall.

2. A method according to claim 1, wherein the central portion is joined to the skirt of the end closure by an annular concave connecting zone and the chuck has a *convex* connection portion between its sidewall and its endwall complementary to that of the annular concave connecting zone of the end closure, the driving engagement being defined by *frictional* contact between the end closure connecting zone and the connecting portion of the chuck.

3. A method according to claim 1, wherein the radius of the container body sidewall at the seam is less than the radius of the [nominal] container body sidewall axially inwardly of the end closure.

10. A method according to claim 3, further comprising forming a plurality of circumferentially spaced, radially inwardly [offset] *extending* and axially inclined ribs in the end closure between the skirt and the central portion, *said ribs each defining a radially inwardly facing surface* for providing *said* driving engagement between the chuck and the preformed end closure along the radially [inward] *inwardly* facing surface of the ribs.

15. A method according to claim 1, wherein the chuck has a transverse end wall and the chuck sidewall tapers axially outwardly, *relative to the end closure*, from the end wall thereof.

*18. A method according to claim 1 wherein the end closure is positioned on the chuck in spaced relation to the chuck sidewall along its entire circumference from said flange to at least partway axially along said skirt.*

*19. A method according to claim 7 wherein:*

*a) the annular step extends radially outwardly to define a radially outermost portion thereof;*

*b) the skirt, between the step and central portion, engages the chuck sidewall upon positioning the end closure on the chuck; and*

*c) the skirt, between the step and the flange, is circumferentially radially spaced along its entire circumference from the chuck sidewall upon positioning the end closure of the chuck.*

*20. A method according to claim 19 wherein the radial outermost portion of the step defines an engagement zone and the container body is nested relative to the end closure to place the engagement zone in contact with the container body.*

*21. A method according to claim 3, wherein the skirt of the end closure has an outer surface facing the container body and a portion of the skirt is frustoconical and joined to the central portion of the end closure by a concave connecting zone and to the flange by a convex connecting zone, the frustoconical portion joining the convex connecting zone by a concave inflection, the inflection between the frustoconical portion and the convex connecting zone defining a zone of contact on the outer surface of the skirt for centering the container body relative to the end closure upon nesting of the container body relative to the end closure.*

*22. A method according to claim 21 wherein:*

*a) the flange of both the end closure and the container body extends radially outwardly to a free edge with the free edge of the flange of the container body being located radially inwardly of the free edge of the flange of the end closure upon said nesting thereof; and*

*b) the container body is nested relative to the end closure to effect engagement between the container body and end closure solely at said zone of contact and at the free end of the flange of the container body with the flange of the end closure.*

*23. A method according to claim 2, further comprising forming a plurality of circumferentially spaced, radially inwardly extending and axially inclined ribs in the annular concave connecting zone of the end closure between the skirt and the central portion, said ribs each defining a radially inwardly facing curved surface for providing said driving engagement between the convex connection portion of the chuck and the preformed end closure along the radially inwardly facing curved surface of the ribs.*

*24. A method according to claim 23 wherein:*

*a) the axially inclined ribs extend through the connecting zone between the skirt and the central portion of the end closure and to about midway along the skirt between the central portion and the flange thereof; and*

*b) the skirt is deformed against the chuck sidewall to flatten and remove the ribs only in the skirt.*

*25. A method according to claim 2 wherein an annular indentation of C-shaped cross-section is formed in the container body sidewall and engages with the skirt of the end closure proximate to the axially inner end of the skirt upon nesting of the container body relative to the end closure.*

*26. A method according to claim 25 wherein: the annular C-shaped indentation of the container body sidewall engages with the skirt approximate where the concave connecting zone of end closure joins the skirt thereof.*

27. A method according to claim 25 wherein during the seaming tool displacement, a portion of the indentation is formed into an annular step extending radially and axially in the container body sidewall between the end of the container body sidewall where the seam is formed and the rest of the container body sidewall, with the end of the container body sidewall being disposed radially inwardly of the rest of the container body sidewall.

*28. A method according to claim 8, wherein the convex connecting zone, along its entire circumference, is located in circumferentially and radially spaced relation to the chuck sidewall upon positioning the end closure on the chuck and is moved into engagement with the chuck sidewall during the seaming tool displacement before the skirt is deformed against the chuck sidewall at the end of radial inward seaming tool displacement.*

*29. The method according to claim 1 wherein:*

*a) the seaming tool is moved out of contact with said seam after the completion of the seaming;*

*b) said skirt of the end closure and the sidewall of the container body are formed of deformable material having an inherent resilience and which springs slightly radially outwardly from the sidewall of the chuck after being deformed radially inwardly against said sidewall and after the seaming tool is moved out of contact with said seam; and*

*c) the chuck has a transverse end wall and the chuck sidewall tapers axially outwardly, relative to the end closure, from the end wall at a predetermined angle whereby the skirt of the end closure after being deformed against the sidewall and after movement of the seaming tool out of contact with said seam springs radially outwardly to a cylindrical configuration.*

*30. A method according to claim 3 wherein:*

*a) the end closure and container body sidewall are formed of sheet metal and each have about equal predetermined thicknesses;*

*b) the seam is formed as a triple seam with seven layers of sheet metal; and*

*c) the radial projection of the seam is reduced to a radius which extends radially beyond the radius of the container body sidewall axially inwardly of the end closure by a radial projection of between about 2 and 4 times said predetermined thickness.*

*31. A method according to claim 30 wherein the radial projection is between about 2 and 3 times said predetermined thickness.*

*32. A method according to any one of claims 3, 10 and 31 wherein:*

*a) the end closure and container body are formed of sheet metal;*

*b) the flange of both the end closure and the container body extends radially outwardly to a free edge with the free edge of the flange of the container body being located radially inwardly of the free edge of the flange of the end closure upon said nesting thereof;*

*c) the skirt of the preformed end closure is frustoconical and joined to the central portion by a concave connecting zone and the flange by a convex connecting zone;*

*d) the end closure is positioned on the chuck with the convex connecting zone, along its entire circumference, located in circumferentially and radially spaced relation to the chuck sidewall; and*

*e) the seaming tool in being displaced radially inwardly to form said seam includes the following seaming steps to form a triple seam having seven layers of sheet metal;*

*i) first forming the free edge of the flange of the end closure into an annular hook located above the free edge of the flange of the container body;*

*ii) thereafter rolling the flanges of the end closure and container body together with respect to each other and at the same time moving the convex connecting zone of the end closure into engagement with the chuck sidewall,*

*iii) continuing the rolling of the flanges to form a tight rolled seam, with the free edges of the flanges clinching each other and at the same time flattening the skirt against the chuck sidewall, and*

*iv) thereafter moving the seaming tool out of contact with said seam.*

* * * * *